US008988710B2

(12) United States Patent
Takahashi

(10) Patent No.: US 8,988,710 B2
(45) Date of Patent: Mar. 24, 2015

(54) PRINTING APPARATUS

(75) Inventor: Yoshihiro Takahashi, Yamato (JP)

(73) Assignee: Canon Kabushiki Kaisha, Tokyo (JP)

( * ) Notice: Subject to any disclaimer, the term of this patent is extended or adjusted under 35 U.S.C. 154(b) by 182 days.

(21) Appl. No.: 13/408,854

(22) Filed: Feb. 29, 2012

(65) Prior Publication Data

US 2012/0229850 A1 Sep. 13, 2012

(30) Foreign Application Priority Data

Mar. 10, 2011 (JP) ..... 2011-053554

(51) Int. Cl.
*G03G 15/00* (2006.01)

(52) U.S. Cl.
CPC ..... *G03G 15/5004* (2013.01)
USPC ..... 358/1.15; 358/2.99

(58) Field of Classification Search
None
See application file for complete search history.

(56) References Cited

U.S. PATENT DOCUMENTS

2005/0157324 A1* 7/2005 Miyazaki ..... 358/1.13
2007/0109583 A1* 5/2007 Yoneoka ..... 358/1.13
2007/0127060 A1* 6/2007 Matsuo ..... 358/1.15
2007/0245164 A1* 10/2007 Mitarai ..... 713/320
2010/0157325 A1* 6/2010 Conlon ..... 358/1.2
2010/0214602 A1* 8/2010 Moriwaki ..... 358/1.15
2010/0253965 A1* 10/2010 Ogisu ..... 358/1.14

FOREIGN PATENT DOCUMENTS

JP 2005210275 A 8/2005
JP 2006236039 A 9/2006

* cited by examiner

*Primary Examiner* — Fred Guillermety
*Assistant Examiner* — Keara Harris
(74) *Attorney, Agent, or Firm* — Fitzpatrick, Cella, Harper & Scinto

(57) ABSTRACT

This invention is directed to a printing apparatus, in which an extension board for PDL processing is added, capable of reducing a waiting time when returning from the power-saving mode upon reception of PDL data. To realize this, upon receiving PDL data before the extension board is ready for use, the apparatus processes the data by using the PDL processing module on the main board. After initializing the extension board, the apparatus uses the added PDL processing module together with that on the main board. Processing the data in this manner makes it possible to start printing the PDL data without consuming a long wait time.

11 Claims, 6 Drawing Sheets

FIG. 4

301

| | 302 TARGET | 303 STATUS | 304 PREPARATION TIME | 305 PERFORMANCE |
|---|---|---|---|---|
| 306 | INTEGRATED | OFF | 1.5 SEC | 1500 VECTORS/SEC |
| 307 | EXTENSION 1 | OFF | 38 SEC | 2000 VECTORS/SEC |

FIG. 5

401

| | 402 Page | 403 PDL | 404 SITUATION |
|---|---|---|---|
| 405 | 1 | INTEGRATED | COMPLETION |
| 406 | 2 | EXTENSION 1 | DURING PROCESSING |
| | ... | | |
| 407 | 5 END | EXTENSION 1 | NOT ALLOCATED |

PRINTING APPARATUS

BACKGROUND OF THE INVENTION

1. Field of the Invention

The present invention relates to a printing apparatus. Particularly, the present invention relates to a printing apparatus which processes the PDL(Page Description Language) data transmitted from a host and prints the resultant data.

2. Description of the Related Art

An apparatus which processes PDL data, for example, a printing apparatus including a PDL printing function, is configured to include an extension board to reduce the PDL processing time, that is, the print processing time, or to increase the number of types of PDL data that can be processed.

For example, Japanese Patent Laid-Open No. 2005-210275 discloses a multifunction peripheral which determines the type of PDL data received via a main board and switches boards to perform processing. In addition, some apparatus is configured to allow both a main board and an extension board to process the same type of PDL data. For example, Japanese Patent Laid-Open No. 2006-236039 discloses a multifunction system which automatically switches processing partitions depending on the performance of the CPU mounted on an optional board.

Recently, there have been strong demands for power-saving of devices, in particular, and many devices have been configured to automatically change to the power-saving mode when they are not used for a predetermined time. For example, some printing apparatus is configured to change to the power-saving mode by being triggered when no print job is received for a predetermined time, and to return from the power-saving mode to the normal operation mode upon reception of a print job.

In many cases, it takes much time to return from the power-saving mode because of the need to perform system initialization to some extent. When pursuing power saving, for example, the power supply to a sensor may be stopped, and the power supply to a memory may be cut off. This leads to the inability to hold the information and statuses which have been held by energization. As a result, the number of elements to be initialized tends to increase. This means that it is impossible to quickly meet a processing request from the user, and the waiting time for the user increases.

Under the circumstances, more demands have arisen for systems which quickly meet requests from the users while promoting power saving.

In addition, even when the power supply is ON, an initialization waiting time is required as in the case of returning from the power-saving mode. There are also demands for waiting time reduction at the time of power ON.

According to the related art, it is possible to implement efficient processing partition in accordance with the processing performance of a PDL processing block on a main board and the processing performance of a PDL processing block on an extension board in a controller in a so-called "steady state" after the startup of a printing apparatus.

However, the related art gives consideration neither to the return time from the power-saving mode and the startup time as described above, nor to the waiting time until the completion of initialization. This makes it impossible to reduce or optimize the time taken for the start of processing at the startup time of the apparatus or at the time of return from the power-saving mode.

SUMMARY OF THE INVENTION

Accordingly, the present invention is conceived as a response to the above-described disadvantages of the conventional art.

For example, a printing apparatus according to this invention is capable of reducing or optimizing the time taken for the start of processing at the startup time of the apparatus or at the time of return from the power-saving mode.

According to one aspect of the present invention, there is provided a printing apparatus which receives PDL data from a host, processes the PDL data, and prints an image on a printing medium, the apparatus comprising: a reception unit configured to receive the PDL data from the host; a main board, including a main CPU, configured to not only control overall operation of the printing apparatus but also process the PDL data; at least one extension board, including a sub-CPU, configured to process the PDL data; and a storage unit configured to store information indicating processing performance of each board which executes processing of the PDL data and a processing status, wherein the main board includes: a selection unit configured to select a board which takes a minimum time to start PDL processing based on information stored in the storage unit, when receiving the PDL data via the reception unit; and a transfer unit configured to transfer the PDL data received via the reception unit to a board selected by the selection unit.

According to another aspect of the present invention, there is provided a printing apparatus comprising: a reception unit configured to receive print data on a page basis; a startup unit configured to start up the printing apparatus based on reception of the print data via the reception unit; a first print data processing unit configured to process the print data; a second print data processing unit configured to have processing performance higher than processing performance of the first print data processing unit and have a preparation time from startup of the printing apparatus longer than a preparation time of the first print data processing unit; and a selection unit configured to select the first print data processing unit until the second print data processing unit becomes ready to process print data and to select the second print data processing unit when the second print data processing unit becomes ready to process print data.

The invention is particularly advantageous since it is possible to perform optimal PDL processing in accordance with the processing performance, or the processing performance and the processing status of each board even when returning from the power-saving mode in response to a PDL processing request from the user or when performing PDL processing immediately after power ON.

That is, this invention comprehends the times taken for the main board and the extension board to start processing and the processing performance of each board, selects a board to perform processing so as to minimize the total waiting time, and transfers PDL data to the selected board to make it process the data. This makes it possible to minimize the processing waiting time in any situation.

Further features of the present invention will become apparent from the following description of exemplary embodiments (with reference to the attached drawings).

BRIEF DESCRIPTION OF THE DRAWINGS

FIG. 4 is a view showing the details of PDL module management information.

FIG. 5 is a view showing the details of PDL processing management information.

DESCRIPTION OF THE EMBODIMENTS

An exemplary embodiment of the present invention will now be described in detail in accordance with the accompanying drawings. Note that an arrangement to be disclosed in the following embodiment is merely illustrative, and the present invention is not limited to the illustrated arrangement.

In this specification, the terms "print" and "printing" not only include the formation of significant information such as characters and graphics, but also broadly includes the formation of images, figures, patterns, and the like on a print medium, or the processing of the medium, regardless of whether they are significant or insignificant and whether they are so visualized as to be visually perceivable by humans.

Also, the term "print medium" not only includes a paper sheet used in common printing apparatuses, but also broadly includes materials, such as cloth, a plastic film, a metal plate, glass, ceramics, wood, and leather, capable of accepting ink.

Furthermore, the term "ink" (to be also referred to as a "liquid" hereinafter) should be extensively interpreted similar to the definition of "print" described above. That is, "ink" includes a liquid which, when applied onto a print medium, can form images, figures, patterns, and the like, can process the print medium, and can process ink. The process of ink includes, for example, solidifying or insolubilizing a coloring agent contained in ink applied to the print medium.

Furthermore, the term "printing element" (to be also referred to as "nozzle" in some case) generically includes an ink orifice, a liquid channel communicating with it, and an element which generates energy used to discharge ink.

<Overall Outline of Printing Apparatus (FIGS. 1A and 1B)>

Figure 1A:
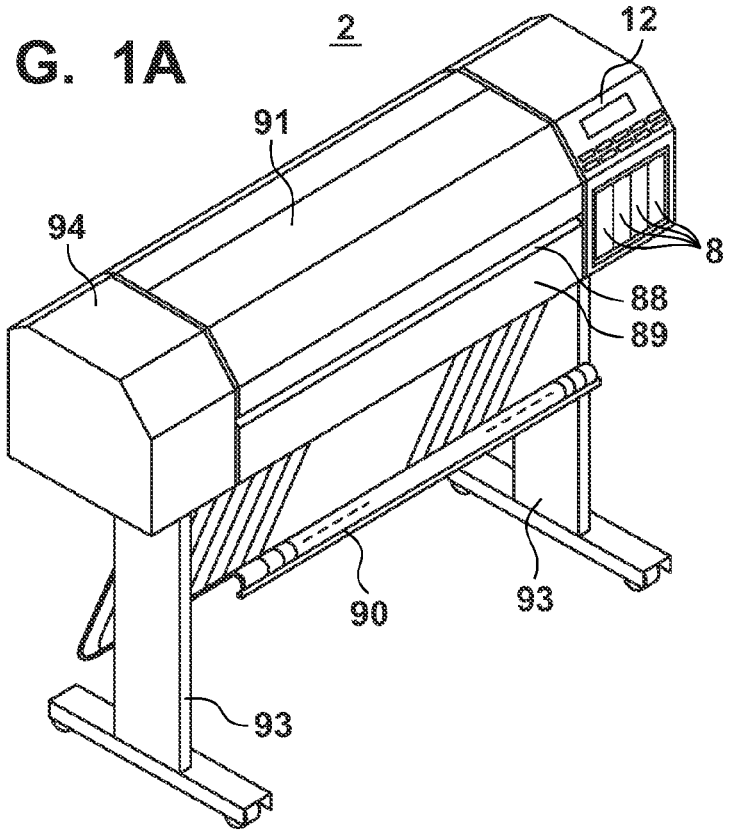
FIGS. 1A and 1B are perspective views showing the outer appearance of a printing apparatus using A0- and B0-size printing media according to a typical embodiment of the present invention.
Figure 1B:
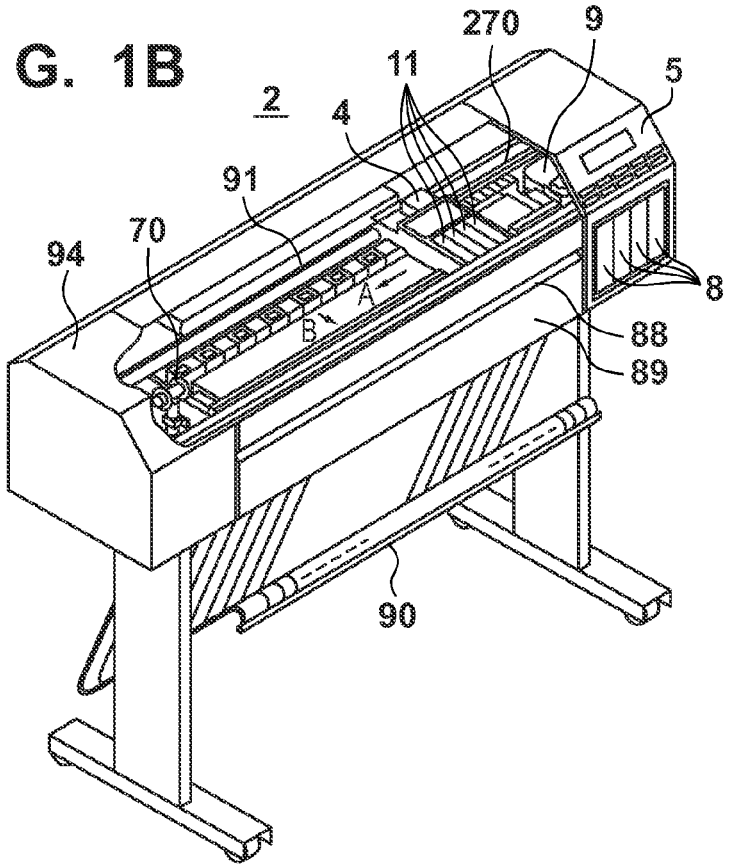

FIGS. 1A and 1B are perspective views showing the outer appearance of a printing apparatus using A0- and B0-size printing media according to a typical embodiment of the present invention. FIG. 1B is a perspective view showing a state in which the upper cover is removed from the printing apparatus shown in FIG. 1A.

As shown in FIG. 1A, a manual insertion port 88 is provided in the front surface of a printing apparatus 2, and a roll paper cassette 89 which can be opened/closed to the front surface is provided below the manual insertion port 88. A printing medium such as printing paper is supplied from the manual insertion port 88 or the roll paper cassette 89 into the printing apparatus. The printing apparatus 2 includes an apparatus main body 94 supported by two leg portions 93, a stacker 90 on which discharged printing media are stacked, and an openable transparent upper cover 91 which allows to see through. An operation unit 12, an ink supply unit, and an ink tank are disposed on the right side of the apparatus main body 94.

As shown in FIG. 1B, the printing apparatus 2 includes a conveyance roller 70 for conveying a printing medium in the arrow B direction (sub-scanning direction) and a carriage 4 which is guided and supported so as to be reciprocable in the widthwise direction (the arrow A direction or main scanning direction) of a printing medium. The printing apparatus 2 further includes a carriage motor (not shown) and carriage belt (to be referred to as a belt) 270 which are used to reciprocably move the carriage 4 in the arrow A direction, and a printhead 11 mounted on the carriage 4. The printing apparatus 2 also includes a suction type ink recovery unit 9 for supplying ink and eliminating an ink discharge failure such as clogging in the orifices of the printhead 11.

In this printing apparatus, the inkjet printhead (to be referred to as the printhead hereafter) 11 is attached to the carriage 4. The printhead 11 includes four heads corresponding to four color inks to perform color printing on a printing medium. The printhead 11 includes, for example, a K head for discharging K (black) ink, a C head for discharging C (Cyan) ink, an M head for discharging M (Magenta) ink, and a Y head for discharging Y (Yellow) ink.

When printing on a printing medium with the above arrangement, the conveyance roller 70 conveys a printing medium to a predetermined printing start position. Subsequently, the carriage 4 repeatedly scans the printhead 11 in the main scanning direction, and the conveyance roller 70 repeatedly conveys the printing medium in the sub-scanning direction, thereby printing on the entire printing medium.

That is, the belt 270 and the carriage motor (not shown) move the carriage 4 in the arrow A direction shown in FIG. 1B to print on the printing medium. When the carriage 4 returns to the position (home position) before it is scanned, the conveyance roller conveys the printing medium in the sub-scanning direction (the arrow B direction shown in FIG. 1B). Thereafter, the carriage is scanned in the arrow A direction shown in FIG. 1B. In this manner, an image, characters, and the like are printed on the printing medium. When this apparatus repeats the above operation and completes printing on a one-sheet portion of the printing medium, the apparatus delivers the printing medium into the stacker 90, thereby completing printing on one sheet.

<Explanation of Control Arrangement (FIGS. 2 and 3)>

A control arrangement for executing printing control in the printing apparatus described with reference to FIGS. 1A and 1B will be described next. The printing apparatus according to this embodiment is configured to be capable of performing PDL printing. The printing apparatus includes a power-saving mode for saving consumption power when the apparatus receives no print job and is in an idling state for a predetermined time or more while power is supplied to the apparatus and a normal operation mode in which the apparatus performs normal printing operation.

Hardware Arrangement

Figure 2:
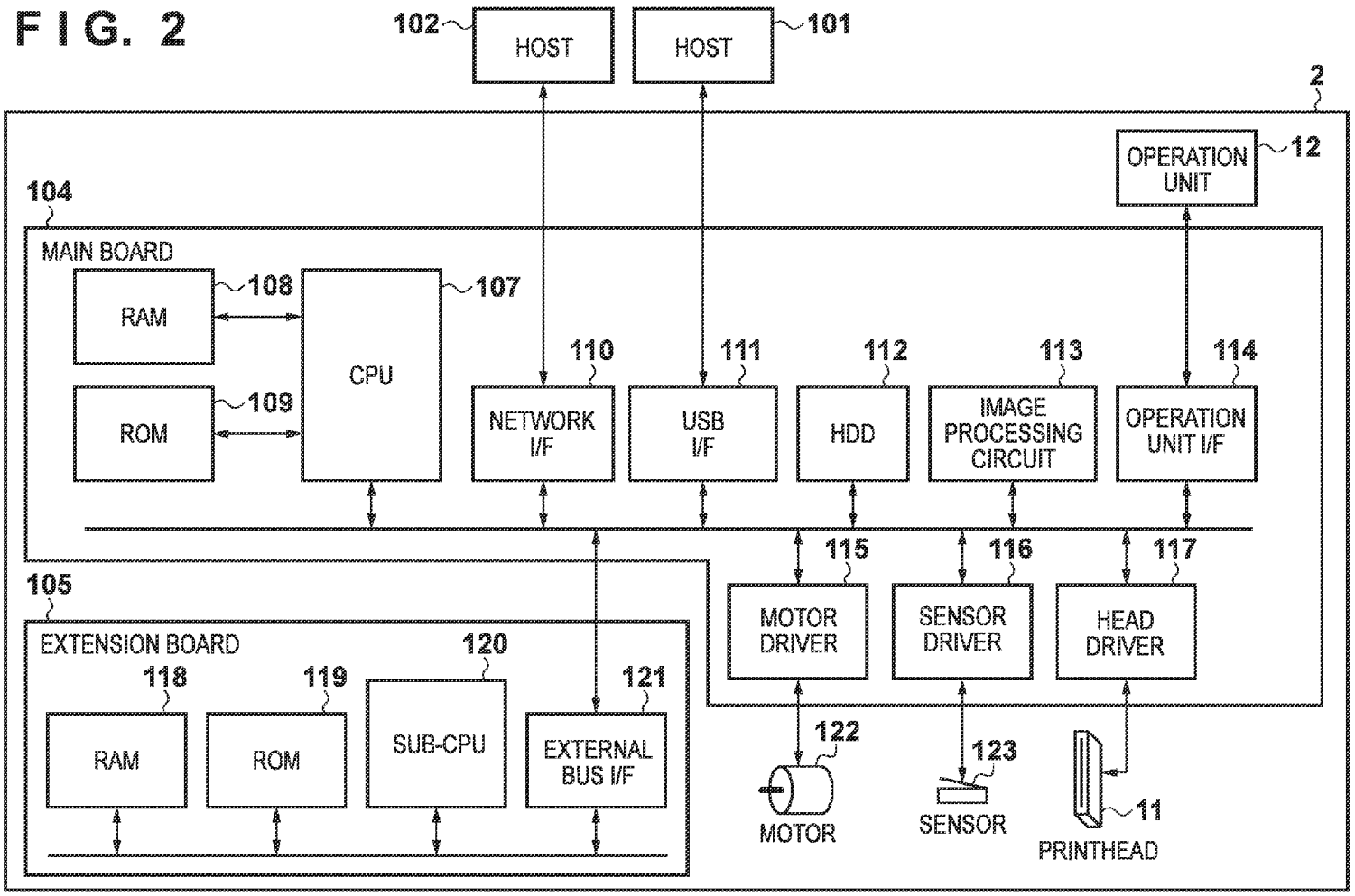
FIG. 2 is a block diagram showing the hardware arrangement of the printing apparatus shown in FIGS. 1A and 1B.

FIG. 2 is a block diagram showing the hardware arrangement of the printing apparatus.

As shown in FIG. 2, the printing apparatus 2 is connected to host apparatuses (hosts) 101 and 102 via a USB interface (I/F) 111 and a network interface (I/F) 110, as core elements of the control arrangement. The printing apparatus 2 includes a main board 104, an extension board 105, and the operation unit 12 including a display unit and operation keys.

The main board 104 includes a CPU 107, a RAM 108, a ROM 109, the network I/F 110, the USB I/F 111, an HDD 112, an image processing circuit 113, an operation unit I/F 114, a motor driver 115, a sensor driver 116, and a head driver 117. The extension board 105 includes a RAM 118, a ROM 119, a sub-CPU 120, and an external bus (BUS) I/F 121 used for connection to the main board 104.

The hardware arrangement also includes a motor 122 connected to the motor driver 115, a sensor 123 connected to the sensor driver 116, and the printhead 11 connected to the head driver 117. Note that the CPU 107 is also called a main CPU.

Each constituent element will be described below.

The printing apparatus 2 is configured to allow the main board 104 to perform PDL printing.

The printing apparatus receives PDL(Page Description Language) data from the host 101 via the USB I/F 111 or the host 102 via the network I/F 110. The CPU 107 performs various kinds of control including PDL processing by executing the programs and the like stored in the ROM 109 using the RAM 108. When executing printing control for PDL data, the apparatus controls various types of circuits and devices (to be described below).

That is, based on a reception job stored in the HDD 112, the CPU 107 renders PDL data and then operates the image processing circuit 113 to execute image processing so as to convert the rendering data into print data. Note that, for example, the CPU 107 starts up and turns off the printing apparatus, controls jobs, and changes print settings based on instructions from the user with the operation unit 12 via the operation unit I/F 114.

The CPU 107 prints print data as an image on a printing medium by controlling the motor 122 connected via the motor driver 115, the sensor 123 connected via the sensor driver 116, and the printhead 11 connected via the head driver 117.

This printing mechanism is controlled by printing control programs stored in the ROM 109 and can print a target image.

As described above, the printing apparatus 2 is configured to print PDL data by using the main board 104 alone. However, connecting the extension board 105 to the printing apparatus 2 allows the extension board with a high processing speed to be made responsible for high-load PDL processing. This can perform high-speed printing by taking full advantage of the performance of the printing mechanism even in the high speed print mode of processing print data.

The extension board 105 has PDL processing capability. That is, the extension board 105 includes the sub-CPU 120 which performs PDL processing and communication processing with the main board 104, the ROM 119 which stores a PDL processing program and the like, and the RAM 118 used as a work area for the processing of a program and PDL data processing. The extension board 105 includes the external bus I/F 121 for connection to the main board 104. The communication program stored in the ROM 119 allows the sub-CPU 120 to communicate with the main board 104. For example, the sub-CPU 120 is activated by the CPU 107.

Software Configuration

Figure 3:
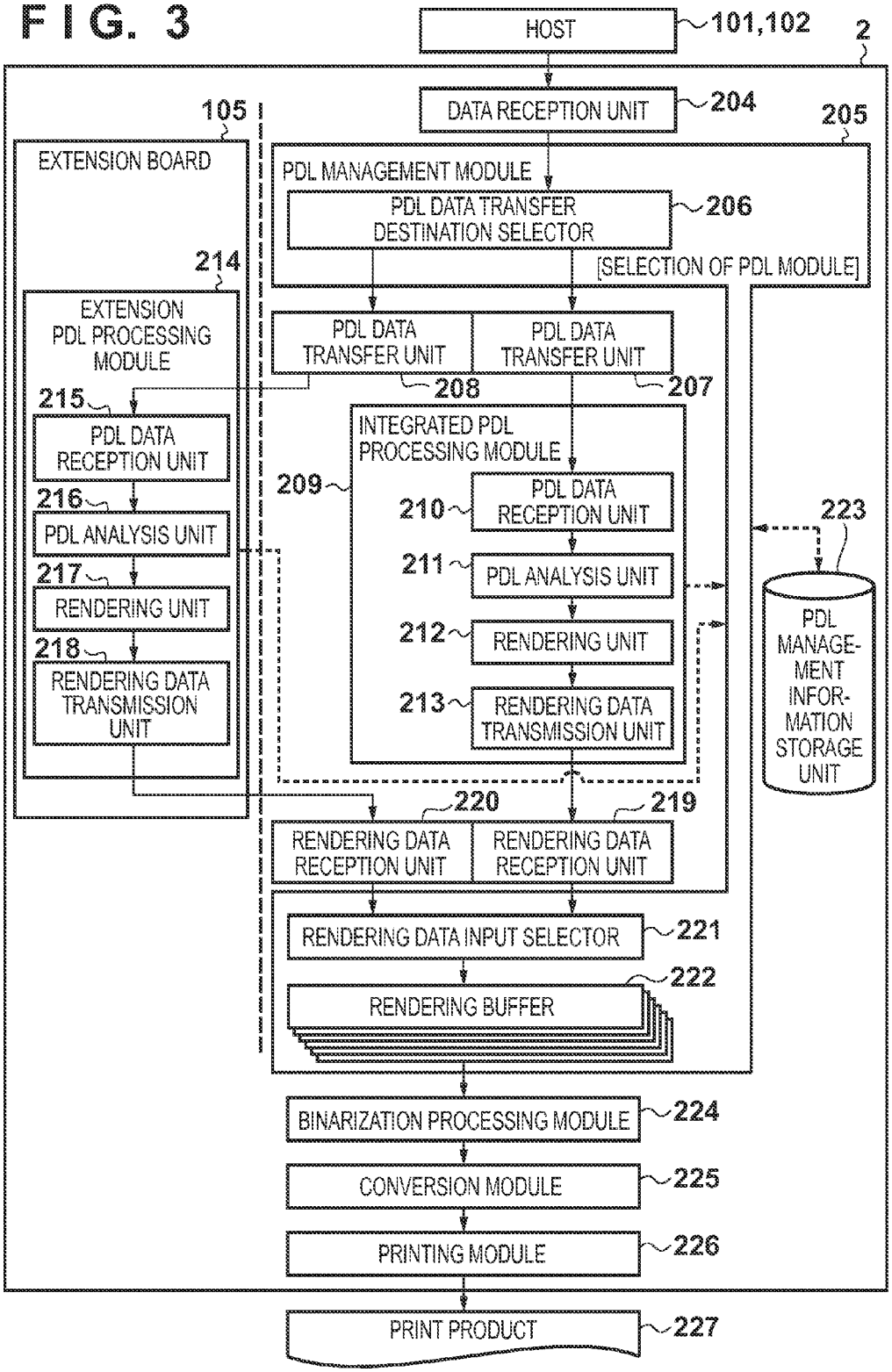
FIG. 3 is a block diagram showing the software configuration of the printing apparatus shown in FIGS. 1A and 1B.

FIG. 3 is a block diagram showing the software configuration implemented by the printing apparatus. The same reference numerals as in FIGS. 1A to 2 denote the same constituent elements in FIG. 3, and a description of them will be omitted.

As shown in FIG. 3, the printing apparatus 2 includes a data reception unit 204 which receives the PDL data transmitted from the hosts 101 and 102 and a PDL management module 205 which manages the received PDL data. The PDL management module 205 includes a PDL data transfer destination selector 206 which selects which one of a plurality of PDL processing modules is to process received PDL data. The printing apparatus 2 further includes a PDL data transfer unit 207 which transfers PDL data to an integrated PDL processing module 209 and a PDL data transfer unit 208 which transfers PDL data to an extension PDL processing module 214 provided in the extension board 105.

The integrated PDL processing module 209 included in the main board 104 includes a PDL data reception unit 210, a PDL analysis unit 211, a rendering unit 212, and a rendering data transmission unit 213. The extension PDL processing module 214 includes a PDL data reception unit 215, a PDL analysis unit 216, a rendering unit 217, and a rendering data transmission unit 218.

The main board 104 also includes a rendering data reception unit 219 which receives PDL rendering data from the integrated PDL processing module 209 and a rendering data reception unit 220 which receives PDL rendering data from the extension PDL processing module 214. The PDL management module 205 further includes a rendering data input selector 221 which determines to select the rendering data generated by the integrated PDL processing module 209 or that generated by the extension PDL processing module 214. A rendering buffer 222 stores the rendering data selected by the rendering data input selector 221.

The printing apparatus 2 further includes a storage unit 223 which stores PDL module management information and PDL processing management information which are used by the PDL management module 205. In addition, the printing apparatus 2 includes a binarization processing module 224 which binarizes data stored in the rendering buffer 222, a conversion module 225 which converts the binarized data into print data, and a printing module 226 which prints print data as a print product 227.

Each constituent element will be described below.

The printing apparatus 2 is configured to be able to perform PDL printing by using the integrated PDL processing module 209 even if the extension board 105 is not installed.

The data reception unit 204 receives the PDL data transmitted from the hosts 101 and 102, and transfers the data to a suitable PDL processing module in accordance with the PDL processing module information managed by the PDL management module 205.

The PDL management module 205 comprehends the number of executable PDL processing modules, the waiting time required for initialization, and the like. The PDL management module 205 further acquires the statuses of PDL processing modules. The storage unit 223 for PDL management information holds the comprehended information. The PDL management module 205 selects a PDL processing module which can perform processing in the shortest time based on the comprehended information, and sets the corresponding information in a PDL data transfer destination selector 206. The PDL data transfer destination selector 206 transfers the data of a processing target page to the set PDL processing module.

Assume that in the printing apparatus 2, the initialization of the extension PDL processing module 214, including the startup of the OS, requires about 1 minute immediately after the startup, and it takes 5 seconds to complete initialization of the integrated PDL processing module 209. That is, the preparation time required to complete the initialization of the extension PDL processing module 214 is longer than that for the integrated PDL processing module 209.

Upon acquiring and comprehending the above information, the PDL management module 205 determines to process the first page by using the integrated PDL processing module 209. In this case, the PDL data transfer destination selector 206 is set to transfer the data to the integrated PDL processing module 209, and transfers the received PDL data to the PDL data transfer unit 207 so as to transfer the PDL data to the integrated PDL processing module 209.

The PDL data transfer unit 207 exchanges PDL data with the PDL data reception unit 210. This data exchange is executed within the same board (main board), and hence is data transmission/reception by simply executing software.

When the printing apparatus 2 has been started up and receives PDL data, both the integrated PDL processing module 209 and the extension PDL processing module 214 have already completed their initialization, and are ready to start PDL processing.

In this case, the apparatus compares the processing performances of the two modules, and selects one of them which can complete the processing in a shorter time. Assume that the processing performance of the extension PDL processing module 214 is 2000 vectors/sec, and that of the integrated PDL processing module 209 is 1500 vectors/sec. Upon comprehending the above information, the PDL management module 205 determines to process the target page by using the extension PDL processing module.

In this case, the PDL data transfer destination selector 206 is set to transfer the data to the extension PDL processing module 214 and transfer the received PDL data to the PDL data transfer unit 208 so as to transfer the data to the extension PDL processing module 214.

The PDL data transfer unit 208 exchanges data with the PDL data reception unit 215. This data exchange is performed with the extension board 105, and hence requires protocol control associated with connection I/F. This processing is performed between these two modules.

The PDL data transferred to either of the PDL processing modules is processed by the PDL analysis unit and rendering unit of the corresponding module, thereby generating rendering data.

In this case, the rendering buffer 222 is required to store the generated rendering data. For this reason, each PDL processing module issues, to the PDL management module 205, a request to acquire the rendering buffer 222. The PDL management module 205 sometimes requests a plurality of PDL processing modules to perform PDL processing associated with different pages. In this case, the PDL management module 205 manages the corresponding information as PDL management information. On the other hand, since the respective PDL processing modules differ in processing speed, it is necessary to receive the processing results upon sequence control.

Assume that while the integrated PDL processing module 209 is processing data corresponding to the first page, the extension PDL processing module 214 starts to process data corresponding to the second page, and the extension PDL processing module is ready to transmit the first rendering data. Such a situation may occur if the processing speed of the extension PDL processing module 214 is high.

In this case, if the rendering buffer 222 is allocated to a rendering buffer acquisition request from the extension PDL processing module 214, the data of the second page mixes with the midway part of the rendering data of the first page generated by the integrated PDL processing module 209. In order to prevent such a state, the PDL management module 205 comprehends which PDL processing module is requested to process which page and the progress situation, that is, whether the processing is complete or halfway through, and allocates a rendering buffer.

Before acquiring the rendering buffer 222, each PDL processing module issues a rendering data transfer request to the PDL management module 205.

Upon determining that data transfer from the source PDL processing module can be accepted in response to the rendering data transmission request, the PDL management module 205 sets the rendering data input selector 221 to connect to the source PDL processing module. After making setting for the rendering data input selector 221, the PDL management module 205 issues a response to permit the rendering data transfer request. Upon receiving the permission to the issued rendering data transmission request, the PDL processing module issues a request to acquire the rendering buffer 222.

Upon receiving the rendering buffer acquisition request from the PDL processing module to which rendering data transfer is permitted, the PDL management module 205 checks whether or not there is an allocatable buffer in the rendering buffer 222. If there is an allocatable buffer, the PDL management module 205 allocates the corresponding buffer from the rendering buffer 222 to the PDL processing module which has issued the rendering buffer acquisition request.

Subsequently, the PDL processing module transfers data to the PDL management module 205 to write the data in the allocated rendering buffer. The PDL processing module repeats acquisition, rendering, and transfer until completely transferring all the rendering data associated with the page of which the module is in charge. The rendering data generated in this manner is stored in the rendering buffer 222 and is finally printed by the printing module 226 through the binarization processing module 224 and the conversion module 225, thereby generating the print product 227.

The software configuration of the printing apparatus and a processing procedure from the reception of data to the printing of the data through PDL processing module switching and the reception of a processing result have been described above.

When the power supply of the printing apparatus having the above arrangement is turned on, the apparatus is started up to execute initialization to initialize the status of the apparatus. When the initialization processing is complete, the startup of the apparatus is complete. When a print job is transmitted from a host in the power-saving mode of the printing apparatus, the apparatus returns to the normal operation mode. When this returning operation is complete (at the time of return), the return is complete.

FIG. 4 is a view showing the details of PDL processing module management information managed by the PDL management module of the printing apparatus. FIG. 4 shows an example of a PDL processing module management information table 301. This table shows records of PDL processing modules as targets in the vertical direction, and the pieces of information of the respective PDL processing modules in the horizontal direction.

The information of each PDL processing module includes a target PDL processing module 302, a status 303 of the PDL processing module, a preparation time 304 necessary to make the PDL processing module ready for use, and a processing performance 305 of the PDL processing module. The records of the PDL processing modules include a record 306 associated with the integrated PDL processing module and a record 307 associated with the extension PDL processing module. In the example shown in FIG. 4, one integrated PDL processing module and one extension PDL processing module exist, that is, a total of two PDL processing modules exist. The preparation time 304 corresponds to the initialization time necessary to execute initialization processing at the time of the startup of the apparatus or the time necessary to return from the power-saving mode to the normal operation mode.

The PDL management module 205 comprehends the number of PDL processing modules ready to process and the like, acquires various kinds of information presented in this table from each PDL processing module, and creates the PDL processing module management information 301. The created PDL processing module management information 301 is used to select a PDL processing module to be made to process received PDL data.

FIG. 5 is a view showing the details of PDL processing management information managed by the PDL management module of the printing apparatus. FIG. 5 shows an example of a PDL processing management information table 401. This table shows information records associated with pages under processing in the vertical direction, and processing information associated with each page in the horizontal direction. The processing information associated with each page includes a management target page 402, a PDL processing module 403 which processes a target page, and a processing status 404 of the target page. The information records associated with pages under processing include a record 405 associated with page 1, a record 406 associated with page 2, and a record 407 associated with page 5 (=last page). The example in FIG. 5 shows a state at a given time point in the procedure of receiving the PDL data of all the five pages, requesting each of one integrated PDL processing module and one extension PDL processing module to perform processing on a page basis, and completing all the processes.

The PDL management module 205 determines a request destination for PDL processing based on the PDL processing module management information 301 on a page basis, and creates and updates the PDL processing management information 401 while issuing the request. The PDL management module 205 uses this information when allocating the rendering buffer 222.

<Explanation of PDL Processing (FIGS. 6 and 7)>

The processing of making the PDL management module 205 select a PDL processing module will be described first.

Figure 6:
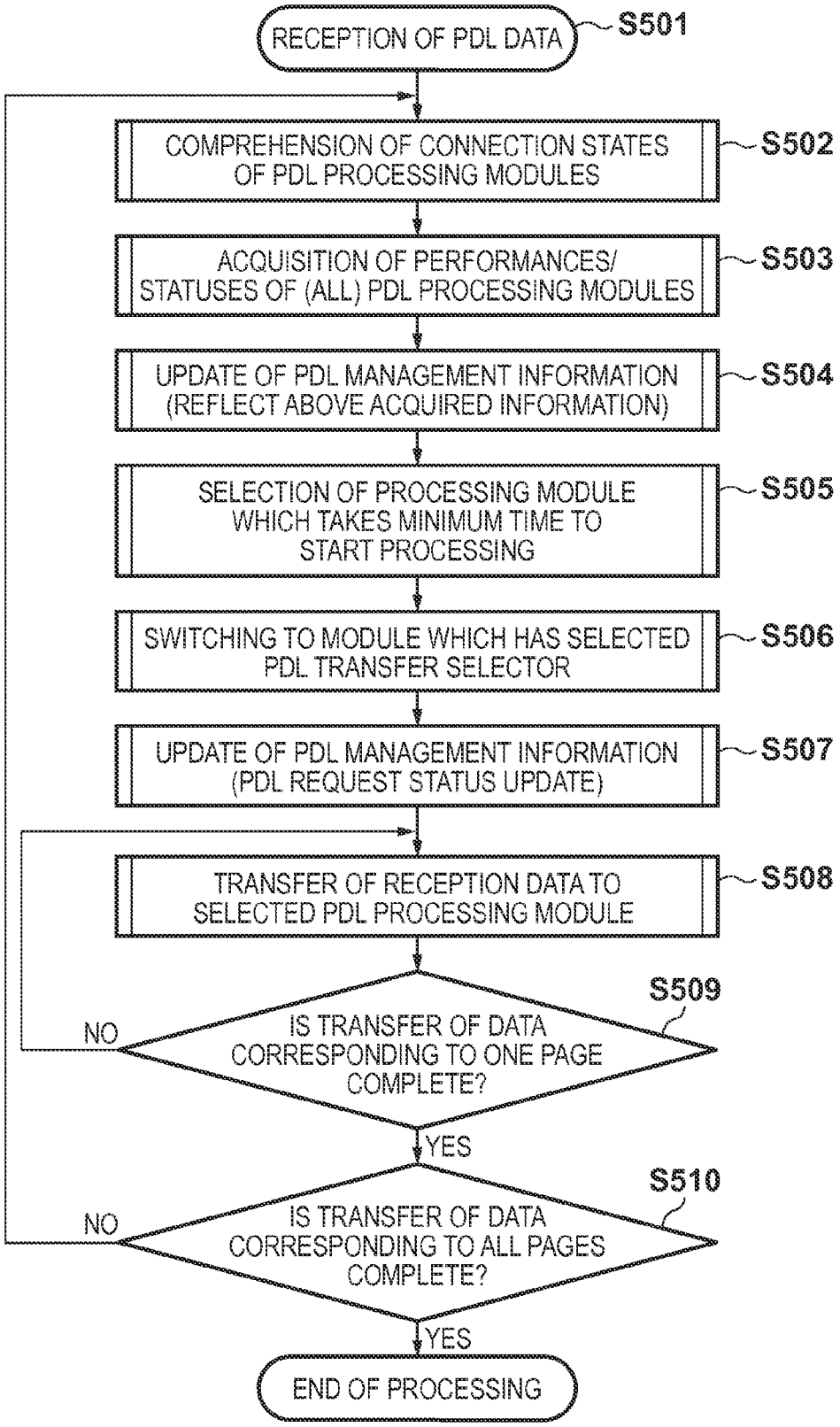
FIG. 6 is a flowchart showing the processing of selecting a PDL processing module for each page.

FIG. 6 is a flowchart showing PDL processing module selection processing for each page.

First of all, upon receiving PDL data in step S501, the PDL management module 205 comprehends the connection states of PDL processing modules in step S502. Thereafter, in step S503, the PDL management module 205 acquires specifications and statuses from all the implemented PDL processing modules. In step S504, the PDL management module 205 updates the PDL management information based on the acquired contents.

The process then shifts to the processing of selecting a PDL processing module based on the acquired information.

In step S505, the PDL management module 205 selects a processing module which requires the minimum (shortest) waiting time until the completion of PDL processing based on the information updated in step S504. In step S506, the PDL management module 205 sets information indicating the selected module in the PDL data transfer destination selector 206. Since the PDL management module 205 has confirmed the request destination associated with the current page, the PDL management module 205 updates the PDL management information in step S507. Such control can be rephrased as follows. The PDL management module 205 selects the integrated PDL processing module 209 until the extension PDL processing module 214 becomes ready to process print data. The PDL management module 205 then selects the extension PDL processing module 214 when the extension PDL processing module 214 is ready to process the print data.

In the loop of steps S508 and S509, the PDL management module 205 transfers PDL data corresponding to one page to the selected PDL processing module. That is, when the transfer of the data corresponding to one page is complete, the PDL management module 205 checks in step S510 whether or not the transfer of the data of all the pages is complete. If there are pages to be transferred, the PDL management module 205 repeats the processing from step S502 by the number of times corresponding to all the pages. Upon completion of the transfer of all the pages, the PDL management module 205 terminates the transfer processing.

The processing of making the PDL management module 205 receive rendering data in response to a rendering request from a PDL processing module for each page will be described next.

Figure 7:
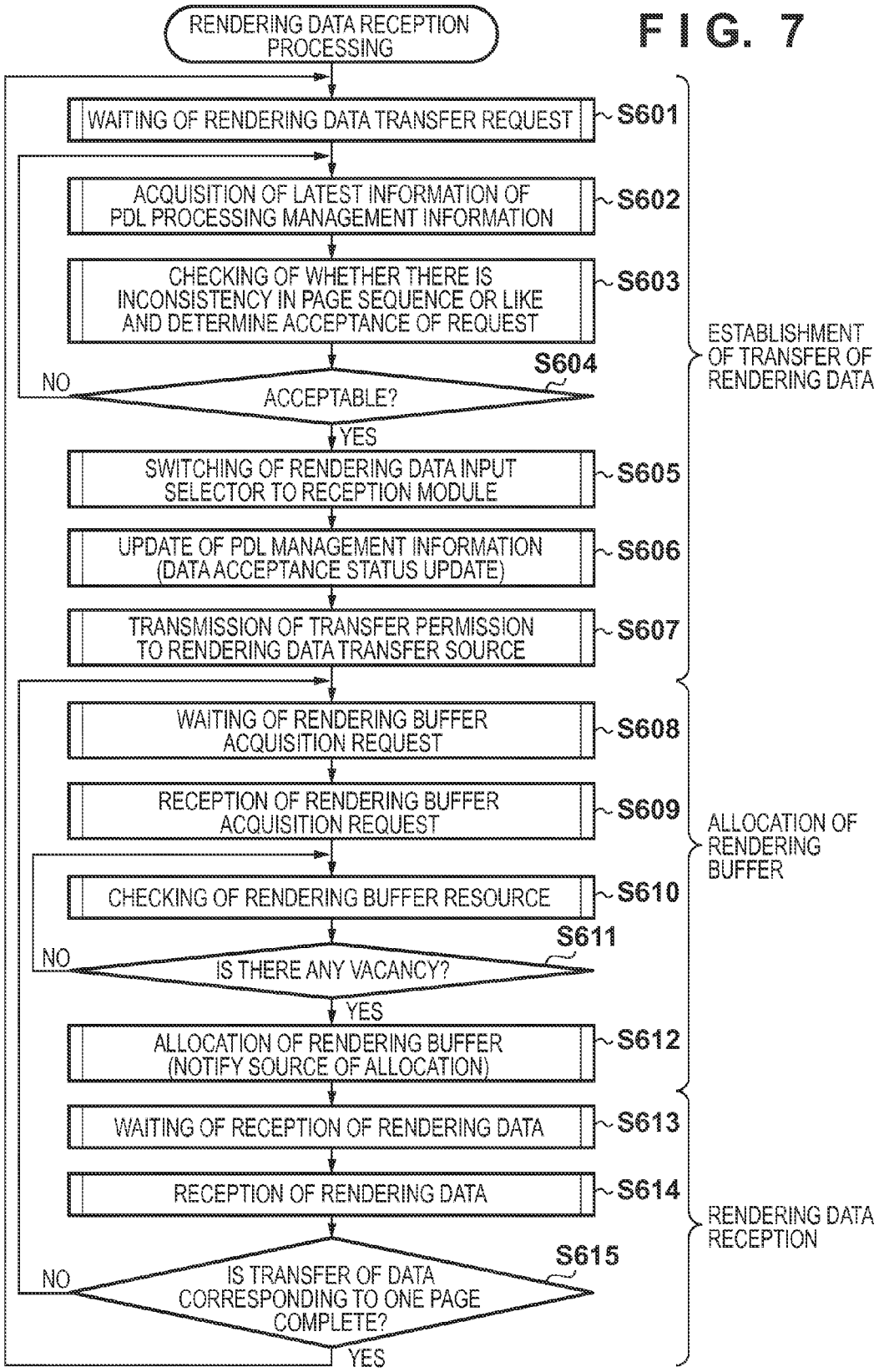
FIG. 7 is a flowchart showing the processing of receiving rendering data from the PDL processing module for each page.

FIG. 7 is a flowchart showing processing to be performed in response to a rendering request from a PDL processing module for each page.

As shown in FIG. 7, this processing corresponds to a rendering data transfer establishment phase at first. Initially, the PDL management module 205 waits for a rendering data transfer request. In this state, when a PDL processing module requires the rendering buffer 222 with the progress of the processing of the PDL data which the module is requested to process by the PDL management module 205, the PDL processing module issues a rendering data transfer request to the PDL management module 205.

That is, in step S601, upon requesting a PDL processing module to perform PDL processing, the PDL management module 205 starts rendering data reception processing and waits for a rendering data transfer request from the PDL processing module. Upon receiving the rendering data transfer request, the PDL management module 205 acquires the latest information of the PDL processing management information 401 in step S602. In step S603, the PDL management module 205 checks whether or not there is an inconsistency in a page sequence.

If the PDL management module 205 determines in step S604 that the request is unacceptable, as in a case in which page data which has been accepted in advance is now being transferred or the accepted page data passes the page number, the process returns to step S602 to suspend the acceptance while monitoring the latest PDL processing information. In contrast to this, if the monitoring result indicates that the rendering data transfer request is acceptable, the PDL management module 205 sets the rendering data input selector 221 to receive data from the source in step S605. In step S606, the PDL management module 205 updates the PDL management information. In step S607, the PDL management module 205 transmits a transfer permission to the PDL processing module as the rendering data transfer request source.

The process then shifts to a rendering buffer allocation phase.

The PDL processing module whose rendering data transfer request has been permitted transmits a rendering buffer acquisition request to the PDL management module 205.

Upon receiving a rendering buffer acquisition request in steps S608 and S609, the PDL management module 205 checks in steps S610 and S611 whether or not there is any allocatable rendering buffer. If there is an allocatable rendering buffer, the PDL management module 205 allocates this buffer to the source in step S612. In contrast to this, if there is no allocatable rendering buffer, the process waits until an allocatable rendering buffer becomes available.

Lastly, the process shifts to a rendering data reception phase.

Upon allocating a rendering buffer to the PDL processing module, the PDL management module 205 waits for the transfer of data from the PDL processing module to the rendering buffer in step S613. On the other hand, to store the PDL data analysis result as image data in the allocated buffer, the PDL processing module transmits the data to the PDL management module 205. In step S614, the PDL management module 205 receives the rendering data and stores it in the rendering buffer 222. In step S615, the PDL management module 205 checks whether or not the reception of rendering data corresponding to one page is complete. If the reception is complete, the process returns to step S608. The PDL management module 205 then repeats allocation of a rendering buffer and reception until completion of the reception. If the transfer of data corresponding to one page is complete, the process returns to step S601 to wait again for rendering data transfer request.

According to the above embodiment, therefore, even an arrangement to which an extension board is added allows to perform optimal PDL processing in accordance with the status of the printing apparatus in response to a PDL data processing request from the user.

The case shown in FIGS. 2 to 5 has exemplified only the arrangement of the printing apparatus including one extension board. However, the number of extension boards which can be installed is not limited to one. The printing apparatus may have an arrangement including two or more extension board mounting slots in accordance with the technical specification of the printing apparatus. This arrangement allows two or more extension boards to be installed on the apparatus. The respective extension boards need not have the same processing performance or the same preparation time. It is possible to install extension boards having different processing performances and different preparation times. In this case, the main board is provided with PDL data transfer units and rendering data reception units as software components corresponding in number to the extension PDL processing modules to be activated on the extension board.

Although the above embodiment uses the so-called large-paper printing apparatus which prints on A0- and B0-size printing media, the present invention can be applied to a printing apparatus which prints on printing media of relatively small sizes such as A4, A3, B4, and B5.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2011-053554, filed Mar. 10, 2011, which is hereby incorporated by reference herein in its entirety.

What is claimed is:

1. A printing apparatus, comprising:

a reception unit configured to receive PDL (Page Description Language) data from a host;

a main board, comprising a main CPU (Central Processing Unit), configured to not only control print operation for printing an image on a printing medium, but also analyze the PDL data and generate rendering data based on the analysis of the PDL data;

at least one extension board, comprising a sub-CPU, configured to analyze the PDL data and generate rendering data based on the analysis of the PDL data; and a storage unit configured to store information indicating a status of said extension board, wherein said main board further comprises:

a selection unit configured to select a board which processes the PDL data based on the information stored in said storage unit, when receiving the PDL data via said reception unit; and a transfer unit configured to transfer the PDL data received via said reception unit to the board selected by said selection unit, wherein the processing performance of said extension board for the PDL data is higher than the processing performance of said main board, and said main board is shorter in initialization time than said extension board, and wherein, in a case where the information stored in said storage unit indicates that said extension board requires initialization to start PDL processing, said selection unit selects said main board, and in a case where the information stored in said storage unit indicates that said extension board does not require initialization to start PDL processing, said selection unit selects said extension board.

2. The apparatus according to claim 1, wherein upon receiving the PDL data from the host via said reception unit at a startup time of the printing apparatus or a return time from a power-saving mode to a normal operation mode, the main CPU of said main board performs control to make said main board start processing the PDL data, without waiting for completion of startup of said extension board, and to make said extension board start processing the PDL data after completion of startup of said extension board.

3. The apparatus according to claim 2, wherein said main board further comprises:

a monitor unit configured to monitor a processing status of each board; and an update unit configured to update the information stored in said storage unit with information indicating a latest status based on a monitoring result obtained by said monitoring unit.

4. The apparatus according to claim 1, wherein said selection unit performs selection for each page of PDL data.

5. The apparatus according to claim 1, further comprising an inkjet printhead configured to print by discharging ink onto the printing medium.

6. The apparatus according to claim 3, wherein said main board further comprises:

a first rendering data reception unit configured to receive the rendering data generated by said main board;

a second rendering data reception unit configured to receive the rendering data generated by said at least one extension board;

a rendering data input selection unit configured to select either the rendering data received by said first rendering data reception unit or the rendering data received by said second rendering data reception unit; and a rendering data buffer configured to store the rendering data selected by said rendering data input selection unit.

7. The apparatus according to claim 6, further comprising a print unit configured to print the image based on the rendering data stored in said rendering data buffer.

8. The apparatus according to claim 7, further comprising a binarization unit configured to binarize the rendering data stored in said rendering data buffer.

9. The apparatus according to claim 6, wherein said monitor unit is further configured to wait and receive a rendering request from said main board and said at least one extension board, and to control said rendering data input selection unit to select said first rendering data reception unit or said second rendering data reception unit in response to the rendering request.

10. The apparatus according to claim 9, wherein said monitor unit is further configured to monitor a number of executable PDL processing boards and a waiting time for initialization of each board.

11. A method for processing PDL (Page Description Language) data transferred from a host in a printing apparatus which processes the PDL data, and prints an image on a printing medium, wherein the printing apparatus comprises a reception unit configured to receive the PDL data from the host, a main board comprising a CPU (Central Processing Unit), and at least one extension board comprising a sub-CPU, the method comprising:

in the main board, controlling not only print operation for printing the image on the printing medium but also analyzing the PDL data, and generating rendering data based on the analysis of the PDL data;

in the at least one extension board, controlling to analyze the PDL data and generating rendering data based on the analysis of the PDL data;

storing in a storage unit, information indicating a status of the extension board;

in the main board, selecting a board which processes the PDL data based on the information stored in the storage unit, when receiving the PDL data by the reception unit; and transferring the PDL data received via said reception unit to the board selected by the selecting step, wherein the processing performance of the extension board for the PDL data is higher than the processing performance of the main board, and the main board is shorter in initialization time than the extension board, and wherein, in a case where the stored information indicates that the extension board requires initialization to start PDL processing, at the selecting step, the main board is selected, and in a case where the stored information indicates that the extension board does not require initialization to start PDL processing, at the selecting step, the extension board is selected.

* * * * *